United States Patent [19]

Erbe

[11] Patent Number: 4,657,323

[45] Date of Patent: Apr. 14, 1987

[54] D-SUBMINATURE FILTER CONNECTOR

[75] Inventor: Alfred R. Erbe, Phoenix, Ariz.

[73] Assignee: ITT Corporation, New York, N.Y.

[21] Appl. No.: 822,446

[22] Filed: Jan. 27, 1986

[51] Int. Cl.[4] ..... H01R 13/66

[52] U.S. Cl. ..... 339/17 R; 29/843; 29/879; 29/883; 339/147 R

[58] Field of Search ..... 339/14 R, 143 R, 147 R, 339/147 P, 218 M, 17 R; 333/182, 183; 29/842, 843, 845, 878, 879, 883

[56] References Cited

U.S. PATENT DOCUMENTS

| | | | |
|---|---|---|---|
| 4,029,386 | 6/1977 | Krantz, Jr. et al. | 339/147 R |
| 4,222,626 | 9/1980 | Hollyday et al. | 339/147 R |
| 4,314,213 | 2/1982 | Wakino | 333/182 |
| 4,329,665 | 5/1982 | Kawai et al. | 339/147 R |
| 4,376,922 | 3/1983 | Muzslay | 333/183 |
| 4,407,552 | 10/1983 | Watanabe | 339/147 R |

FOREIGN PATENT DOCUMENTS

| | | | |
|---|---|---|---|
| 123457 | 10/1984 | European Pat. Off. | 339/143 R |

*Primary Examiner*—John McQuade
*Attorney, Agent, or Firm*—T. L. Peterson

[57] ABSTRACT

A filter connector is provided which is rugged and can be constructed at very low cost. The connector includes a front shell of metal which has a rearwardly-facing ledge, a circuit board device which includes a board of insulative material with a circuit layer on its rearward face, a rear insulator with a front portion lying within the rear of the front shell, and several contacts extending through holes in the circuit board device and insulator. The circuit layer includes capacitors around holes through which the contacts extends, with each contact soldered to a terminal of the capacitor, and the edge of the circuit soldered to the front shell. The rear insulator is molded in place to the circuit board device and within the rear of the front shell, with some of the insulator extending rearwardly of the front shell. The portion of the insulator extending rearwardly of the front shell is devoid of any metal shell immediately surrounding it.

7 Claims, 4 Drawing Figures

D-SUBMINATURE FILTER CONNECTOR

BACKGROUND OF THE INVENTION

Filter connectors are broadly used to control electromagnetic interference as by capcitively coupling contacts to ground. D-Subminature connectors with capcitively coupled contacts are manufactured and sold in large quantities, and the marketplace is extremely cost conscious. A typical prior art D-Subminature connector includes front and rear shells, front and rear insulators, and contacts passing through the insulators and shells. One type of filter connector includes a printed circuit board lying within the shells between the insulators, and bearing capacitors that are connected to selected contacts. The two shells each have flanges or tabs at their outer ends that lie facewise against one another and which have holes for mounting the connector. A filter connector which could be constructed at an especially low cost, would be of considerable value in the very high volume manufacture of filtered subminature connectors.

SUMMARY OF THE INVENTION

In accordance with one embodiment of the present invention, a connector is provided which can be constructed at an especially low cost. The connector can include a front metal shell, a circuit board device trapped in the shell, and a rear insulator having a front portion molded in place within the rear of the front shell and against the circuit board device, the rear insulator having a rear portion extending behind the front shell and devoid of any metal shell extending around it. The circuit board device includes an insulative board with a printed circuit on its rear face, the circuit including at least one capacitor with one terminal connected to a contact and another terminal connected to the metal shell. The rear of the shell and the rear face of the circuit board device form the front of a mold into which the rear insulator is molded.

In a pin-type connector, where the front mating ends of the contacts do not have to be surrounded by a front insulator, the front face of the circuit board can lie against a rearwardly-facing ledge formed on the front shell. The board of the circuit board device, therefore forms the front face of the inside of the connector. In a socket-type connector where the socket contacts require support by a front insulator around them, the front insulator bears against the ledge on the front shell, while the circuit board device lies behind the front insulator.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
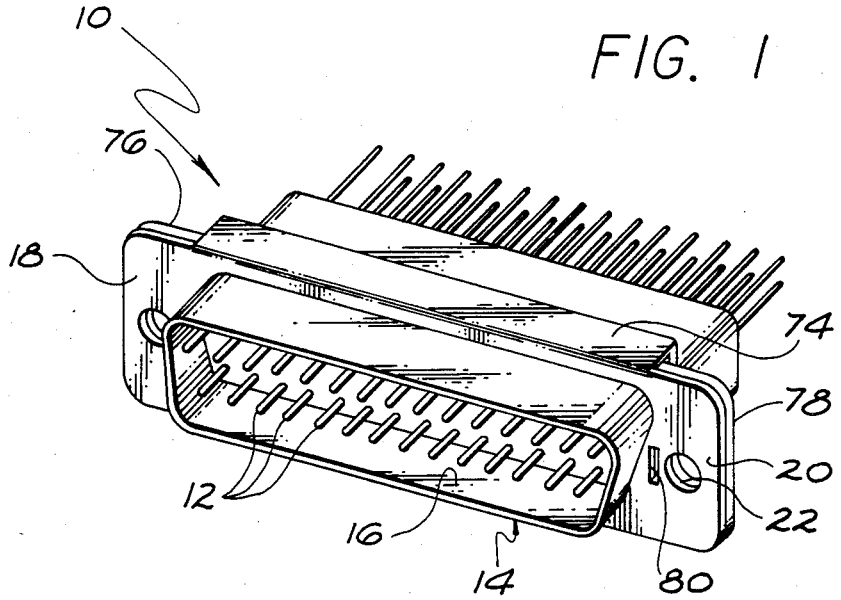
FIG. 1 is a perspective view of a connector constructed in accordance with one embodiment of the present invention.

FIG. 1 illustrates a D-subminature connector 10 of the plug type which includes pin contacts 12, the connector designed to be mated with another D-subminature type of opposite gender which has the same number of contacts, and which slides inside the space 16. The connector includes a front shell 14 with a hollow front portion and with flanges or tabs 18, 20 at opposite ends of the shell, each end having a hole 22 for mounting against a mating connector, and also possibly to a panel or other supporting device.

Figure 2:
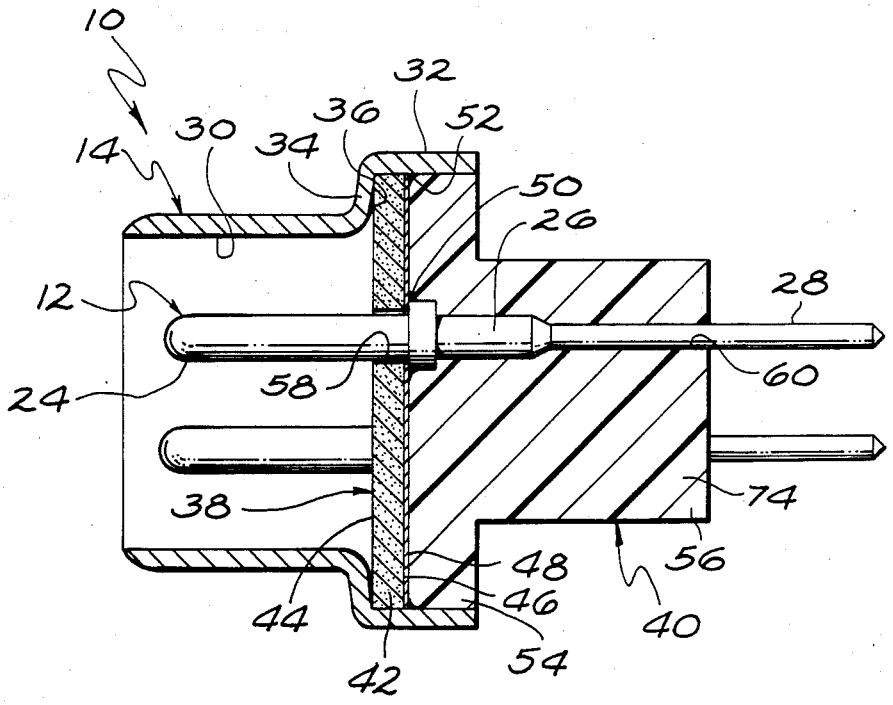
FIG. 2 is a sectional view of the connector of FIG. 1.

As also shown in FIG. 2, each contact 12 has a mating front end 24, a middle 26, and a rear end 28. The front shell 14 has a hollow front portion 30 which surrounds the mating front ends 24 of the contacts, and an enlarged rear portion 32 of greater width than the front portion. The front and rear portions of the shell are connected by an intermediate portion 34 which forms a rearwardly-facing ledge 36.

The contacts extend through holes in a circuit board device 38, and through corresponding holes in a rear insulator 40. The circuit board device includes a board 42 of insulative material such as ceramic having forward and rearward faces 44, 46 and a circuit layer 48 on the rearward face of the board. The circuit board device 38 lies within the rearward portion 32 of the shell, with the forward face 44 of the circuit board device lying against the ledge 36 formed by the shell. The circuit layer 48 is joined to all contacts or to selected contacts by solder connections 50, and is joined to the front shell by another solder connection 52.

The rear insulator 40 includes a forward portion 54 which is molded in place to the rear of the circuit board device 38 and to the rear shell portion 32. The rear insulator also includes a rear portion 56 extending rearwardly of the rear shell portion 32. In particular, the rear portion 56 of the rear insulator is devoid of a metal shell surrounding it, but relies solely on its connection to the other parts of the connector when it is molded in place, to hold itself in the connector. The circuit board device 38 and rear insulator 40 have holes 58, 60 through which the contacts extend.

Figure 3:
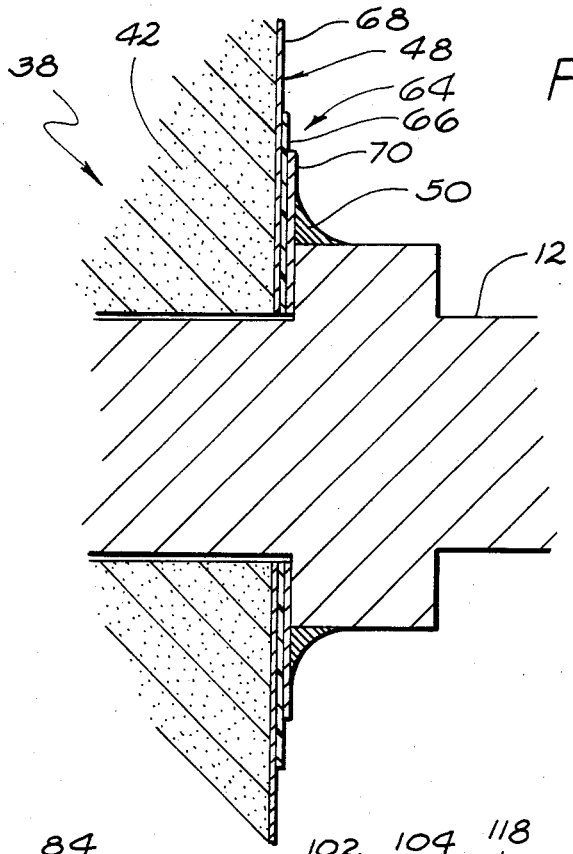
FIG. 3 is an enlarged view of a portion of FIG. 2.

As shown in FIG. 3, the circuit layer 48 includes a capacitor 64 formed around the contact 12. The capacitor includes a dielectric 66, a grounded first terminal 68 on one side of the dielectric, and a second terminal 70 on the other side of the dielectric. The second terminal 70 is connected to the contact 12 through the solder joint 50. The ground terminal 68 is connected to the metal shell through another solder joint. The solder joints not only electrically join the capacitor to the contact, but also seal the space between the circuit board device and contact, during the molding of the rear insulator. The solder joint between the edge of the circuit layer and the metal shell also seals in the molding material while it is molded in place. In many cases, all or most of the contacts are capacitively filtered, so sealing is achieved to allow highly liquid molding compound to be used for the rear insulator.

The rear insulator not only includes a central portion 74 through which the contacts extend, but also includes flange portions 76, 78 (FIG. 1) which extend along the rearward face of each metal flange or tab 18, 20 of the metal front shell. The metal tabs have slots 80 that receive the molded rear insulator to provide mechanical holding as well as holding by adhesion of the insulator molding material to the metal shell. The insulator flanges 76, 78 strengthen the metal tabs 18, 20 against bending, to strengthen the tabs where they are not strengthened by tabs on any metal rear shell.

The parts of the connector can be easily manufactured and then assembled, at low cost. Only a single metal shell 14 is required, and can be of a relatively simple shape. The board 42 of the circuit board device 38 is required in any case to support the printed circuit of the circuit layer 48, and using this circuit board as the most forward insulative part of the connector avoids the need for an additional front insulator in the case of a pin connector. The soldering operation can be performed by prior art low-cost methods. The molding of the rear insulator 40 is accomplished by orienting the shell and circuit board device so their front parts face downwardly, surrounding a region above them by a partial mold that forms the rear insulator portion 56, and pouring an insulative molding compound into the resulting mold. The connector uses a minimum number of relatively simple devices, so it can be manufactured at an especially low cost.

Figure 4:
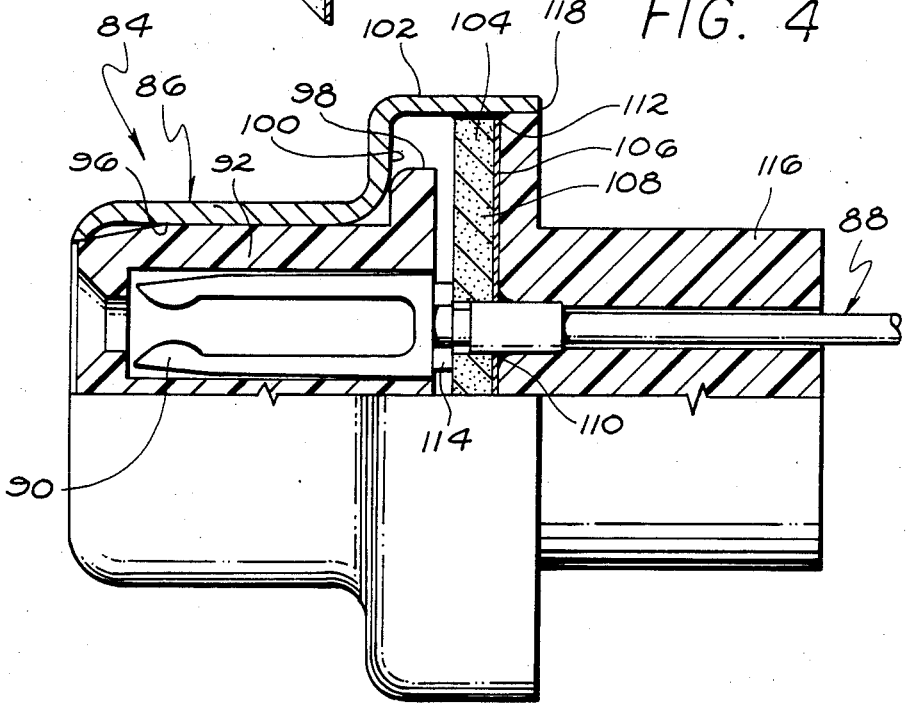
FIG. 4 is a partially sectional view of a socket connector constructed in accordance with another embodiment of the invention.

FIG. 4 illustrates a receptacle connector 84, which also includes only a single metal shell 86. Each contact 88 has a pin-receiving mating front end 90 which must be surrounded by an insulator to limit its expansion. Accordingly, applicant includes a preformed front insulator 92 which lies in the hollow front portion 96 of the shell. The front insulator includes a rear end 98 which abuts the rearwardly-facing ledge 100 of the front shell, which connects the hollow front portion 96 of the shell to the rear portion 102. A circuit board device 104 which is substantially identical to the circuit board device 42 of FIG. 2 except for differences in its holes and outer dimensions, lies behind the rear end 98 of the front insulator. The circuit layer 106 which lies on the board 108 of the circuit board device, is connected by soldered connections 110, 112 to the contact and to the metal shell. The particular contact 88 shown in FIG. 8 is a type which has been produced for other connectors, and includes a projection 114 (which extends in directions into and out of the sheet) that lies between the rear of the front insulator 92 and the insulative board 108 of the circuit board device. If new socket contacts are to be manufactured, they may be constructed without such a projection, so the circuit board device 104 will abut the rear of the front insulator.

A rear insulator 116 is molded in place within the rear end 118 of the rear shell portion, and against the circuit board device 104, in the same manner as the rear insulator of the connector of FIG. 2. The rear insulator 116 includes portions (not shown) similar to the ends shown at 76 and 78 in FIG. 1, which back up the flanges or tabs at the ends of the metal shell.

Thus, the invention provides a connector of the type which includes capacitively filtered contacts, which can be constructed at low cost. This is accomplished by using a minimum of parts, the pin version of the connector including a circuit board as the frontmost insulating element (its front face can be coated by epoxy for appearance). Only a single metal shell is used, and a rear insulator is molded in place, with its front portion molded by the walls of the shell and the rear of the circuit board device.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector comprising:

a plurality of contacts, each having a mating front end, a middle, and a rear end;

a front shell of metal with a hollow front portion which surrounds said mating front ends of said contacts, and an enlarged rear portion of greater width than said front portion, said shell forming a rearwardly-facing ledge between said portions;

a circuit board device which includes a board of insulative material having forward and rearward faces and edges, and a circuit layer on the rearward face of the board, said board lying within said shell with its forward face against said ledge of said shell, said circuit device including holes through which said contacts extend, and said circuit layer including a plurality of capacitors each having a first capacitor terminal adjacent to one of said holes and a second capacitor terminal extending to an edge of the board, and including solder means joining each first capacitor terminal to a contact and joining an edge of the second capacitor terminal to the shell;

a rear insulator having a forward portion molded in place to the circuit board device and to the rear portion of said shell, said contacts molded into said rear insulator with their rear ends extending rearwardly of the rear of said rear insulator.

2. The connector described in claim 1 wherein:

said rear insulator includes a rear end portion that extends rearward of said shell rear portion, said rear end portion of said rear insulator being devoid of any metal shell surrounding it.

3. The connector described in claim 1 wherein:

said front shell is empty, except for said contacts, at locations forward of said circuit board device.

4. The connector described in claim 1 wherein:

said front shell has opposite ends and has tabs extending in opposite directions from its opposite ends.

5. A socket connector comprising:

a plurality of socket contacts, each including a mating front end, a middle, and a rear end;

a metallic shell with a hollow front portion which surrounds said mating front ends of said contacts, and an enlarged rear portion of greater width than said front portion, said shell forming a rearwardly-facing ledge between said portions;

a front insulator which has a front portion that lies in said shell hollow front portion and surrounds the mating front ends of the contacts, and an enlarged rear portion that abuts the rearwardly-facing shell ledge;

a circuit board device which includes a board of insulative material having forward and rearward faces and edges, and a circuit layer on the rearward face of the board, said board lying within said shell with its forward face facing said front insulator, said circuit board device including holes through which said contacts extend, and said circuit layer including a plurality of capacitors each having a first capacitor terminal adjacent to at least one of said holes and a second capacitor terminal extending to an edge of the board, and including solder means joining each first capacitor terminal to a contact and joining an edge of the second capacitor terminal to the shell;

a rear insulator having a forward portion molded in place to the circuit board device and to the rear portion of said shell, said contacts molded into said rear insulator with their rear ends extending rearwardly of the rear of said rear insulator.

6. The connector described in claim 5 wherein:

said connector has only a single metallic shell surrounding said rear insulator.

7. A method for constructing a connector with filtered contacts at low cost, comprising:

forming a front shell which has a forward portion and a wider rearward portion, and a ledge between them;

installing a circuit board device in said shell wherein the circuit board device includes an insulative board with front and rear faces and a thin circuit fixed to the rear face, so the front surface lies against said ledge, with the circuit board device having multiple holes and the circuit including a plurality of capacitors that each have a first terminal adjacent to a hole and another ground terminal, the ground terminals connected together;

installing a plurality of contacts in said circuit board device so the contacts project through the holes in the device;

soldering a plurality of said contacts to said first capacitor terminals, and soldering the ground terminal to said shell; and applying fluid but hardenable insulative molding material to the rear of said circuit board device, within the rear of said shell rearward portion, and around said contacts to a thickness greater than said circuit board device.

* * * * *